US007258085B2

(12) United States Patent
Niiyama et al.

(10) Patent No.: US 7,258,085 B2
(45) Date of Patent: Aug. 21, 2007

(54) CONTROL DEVICE FOR FREE PISTON ENGINE AND METHOD FOR THE SAME

(75) Inventors: Yasunori Niiyama, Kariya (JP); Takashi Kaneko, Nagoya (JP); Yasumasa Hagiwara, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 86 days.

(21) Appl. No.: 11/298,579

(22) Filed: Dec. 12, 2005

(65) Prior Publication Data

US 2006/0124083 A1 Jun. 15, 2006

(30) Foreign Application Priority Data

Dec. 15, 2004 (JP) ..... 2004-363402

(51) Int. Cl.
*F02B 71/00* (2006.01)
*F02B 71/04* (2006.01)

(52) U.S. Cl. ..... 123/46 R; 123/46 E

(58) Field of Classification Search ..... 123/46 R, 123/46 E
See application file for complete search history.

(56) References Cited

U.S. PATENT DOCUMENTS 4,491,095 A * 1/1985 Coad ..... 123/46 R
6,276,313 B1 8/2001 Yang et al.
6,397,793 B2 6/2002 Yang et al.
6,945,202 B2 9/2005 Kaneko et al.

* cited by examiner

*Primary Examiner*—Noah P. Kamen
(74) *Attorney, Agent, or Firm*—Nixon & Vanderhye P.C.

(57) ABSTRACT

A free piston engine has a pair of pistons opposing to each other and movable in a cylinder, to form a combustion chamber between the pistons. A mixed gas of air and fuel is supplied into the combustion chamber and the mixed gas is auto-ignited when it is compressed by the pistons. A temperature and/or an air-fuel ratio of the mixed gas, and/or a pressure in the combustion chamber is detected to control displacements of the pistons, so that the mixed gas is auto-ignited at an optimum timing to efficiently operate the free piston engine.

7 Claims, 10 Drawing Sheets

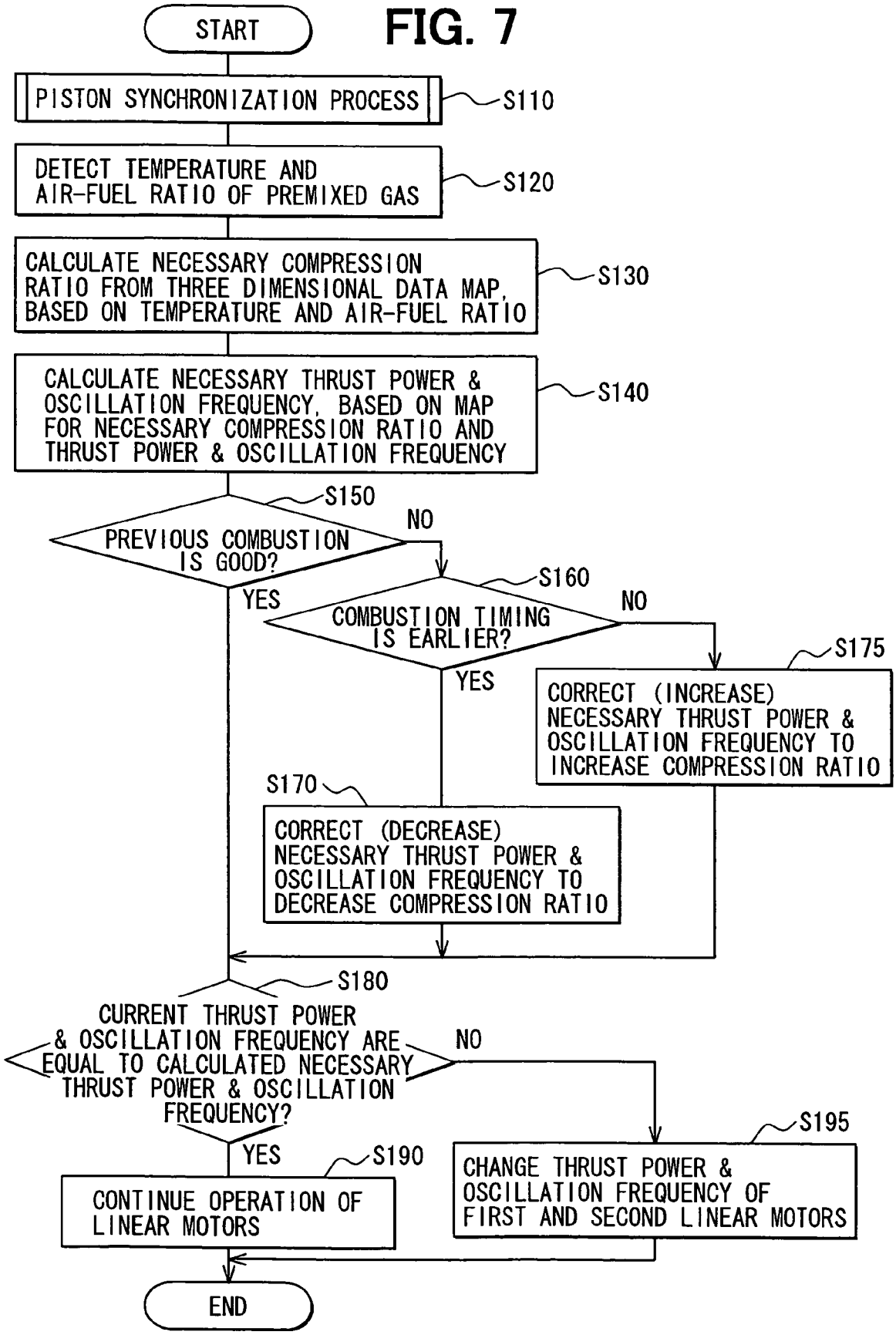
FIG. 7
START
PISTON SYNCHRONIZATION PROCESS
S110
DETECT TEMPERATURE AND AIR-FUEL RATIO OF PREMIXED GAS
S120
CALCULATE NECESSARY COMPRESSION RATIO FROM THREE DIMENSIONAL DATA MAP, BASED ON TEMPERATURE AND AIR-FUEL RATIO
S130
CALCULATE NECESSARY THRUST POWER & OSCILLATION FREQUENCY, BASED ON MAP FOR NECESSARY COMPRESSION RATIO AND THRUST POWER & OSCILLATION FREQUENCY
S140
S150
PREVIOUS COMBUSTION IS GOOD?
NO
YES
S160
COMBUSTION TIMING IS EARLIER?
NO
YES
S175
CORRECT (INCREASE) NECESSARY THRUST POWER & OSCILLATION FREQUENCY TO INCREASE COMPRESSION RATIO
S170
CORRECT (DECREASE) NECESSARY THRUST POWER & OSCILLATION FREQUENCY TO DECREASE COMPRESSION RATIO
S180
CURRENT THRUST POWER & OSCILLATION FREQUENCY ARE EQUAL TO CALCULATED NECESSARY THRUST POWER & OSCILLATION FREQUENCY?
NO
YES
S190
CONTINUE OPERATION OF LINEAR MOTORS
S195
CHANGE THRUST POWER & OSCILLATION FREQUENCY OF FIRST AND SECOND LINEAR MOTORS
END

CONTROL DEVICE FOR FREE PISTON ENGINE AND METHOD FOR THE SAME

CROSS REFERENCE TO RELATED APPLICATION

This application is based on and incorporates herein by reference Japanese patent application No. 2004-363402 filed on Dec. 15, 2004.

FIELD OF THE INVENTION

The present invention relates to a control device and a method for controlling a free piston engine used for, for example, electric power generation.

BACKGROUND OF THE INVENTION

An electric power generator using a free piston engine is known, for example, in a PCT JP-Publication No. 2003-519328 (which corresponds to U.S. Pat. Nos. 6,397,793 and 6,276,313).

The electric power generator disclosed in this publication has the free piston engine and a power generation means. The free piston engine includes two opposed pistons in a cylinder and back pressure chambers as air spring means respectively arranged at back sides of the pistons, and the power generation means has an electromagnet for transforming kinetic energy of the pistons into electric energy.

In the free piston engine, mixed gas in a combustion chamber formed between the pistons is auto-ignited by being compressed when the pistons move closer to each other. An explosion of the ignited gas generates a driving force to push the pistons in directions in which the pistons move away from each other. At this time, back pressure chambers are compressed and then the pistons are pushed back in the opposite directions, that is, directions in which the pistons move closer to each other. Repetition of these movements causes back-and-forth movements of the pistons, and the power generation means produces electric power by transforming the kinetic energy of the back-and-forth movements of the pistons to the electric energy.

In the electric power generator, the power generation means applies a force to each of the pistons so that the pistons move synchronously, that is, the heading directions of the pistons are always opposite and a phase difference of their back-and-forth movements is 180 degrees.

In the free piston engine, a combustion condition (e.g. a combustion timing) changes depending on a temperature, an air-fuel ratio, and a density distribution of the mixed gas, because the mixed gas is auto-ignited as a result of the compression of the mixed gas, unlike an engine in which the mixed gas is ignited by a spark plug.

Therefore, depending on the temperature, the air fuel ratio of the mixed gas and so on, the mixed gas may be auto-ignited in advance of an optimum timing during a compression stroke (i.e. a timing for most efficiently transforming the energy of fuel to the driving force of the pistons), even if the synchronization of the pistons is achieved. In other cases, the mixed gas may not be auto-ignited even when the compression stroke has ended and the pistons start getting away from each other (that is, misfires of the free piston engine). Therefore, it is difficult to operate the conventional piston engine with constant efficiency. In other words, it is difficult to make the pistons efficiently move back-and-forth. The inefficient operation of the free piston engine would result in the inefficient generation of the electric power using the free piston engine.

SUMMARY OF THE INVENTION

The present invention is made in view of the above problems. It is an object of the present invention to efficiently operate a free piston engine having two opposing pistons, in which mixed gas is auto-ignited by compression.

A free piston engine, to which the present invention is applied, comprises: a housing including a cylinder in its interior; and a first and a second pistons respectively installed and movable in the cylinder, and the first and the second pistons opposing to each other in an axial direction of the cylinder.

The free piston engine further comprises: a combustion chamber formed in the cylinder between the first and second pistons; an intake means for supplying mixed gas of air and fuel into the combustion chamber; an exhaust means for exhausting combustion gas of the mixed gas; and a first and a second biasing units for respectively biasing the first and second pistons in respective directions so that the first and the second pistons move closer to each other.

In the free piston engine, the mixed gas in the combustion chamber is auto-ignited by being compressed when the pistons move closer to each other, and the first and second pistons are moved in directions away from each other due to an explosion of the mixed gas. Subsequently, the pistons are moved closer to each other again by biasing forces of the first and second biasing units, so that a fresh mixed gas is compressed and auto-ignited in the same manner.

The free piston engine further comprises: a first drive means for adjusting a displacement of the first piston from a first reference position by means of a magnetic force; and a second drive means for likewise adjusting a displacement of the second piston from a second reference position by means of a magnetic force.

A control device for the above free piston engine detects a physical quantity by which a condition of the combustion of the free piston engine can be estimated. A displacement control means of the control device controls, according to the detected physical quantity, displacements of the first and second pistons from the reference positions so that the mixed gas in the combustion chamber is auto-ignited at such a timing equal to or close to an end of a compression stroke during which the first and second pistons are moved closer to each other.

As above, according to the above control device, the displacements of the pistons are actively controlled so that the mixed gas in the combustion chamber is auto-ignited at a specified timing, which is the end of the compression stroke or close to the end, that is, at an optimum ignition timing for efficiently transforming an energy of a fuel to a driving force of the piston.

Therefore, it is possible to avoid such an inefficient combustion, in which the mixed gas is ignited before the optimum ignition timing or the mixed gas is not ignited even when the compression process ends and an expansion stroke starts, in which the pistons start moving away from each other. As a result, the energy of the fuel can be efficiently converted to the driving force of the pistons, to thereby constantly and efficiently operate the free piston engine.

According to another feature of the present invention, at least one of the physical quantities, such as a temperature of the mixed gas, an air-fuel ratio of the mixed gas, and a pressure in the combustion chamber, is preferably detected.

In particular, when the temperature of the mixed gas and/or the air-fuel ratio is detected, the displacements of the pistons can be properly controlled based on the detected physical quantity(ies), so that the mixed gas can be auto-ignited at its optimum timing in each of the compression strokes. In other words, a failure of the auto-ignition or the auto-ignition at an improper timing can be prevented.

Furthermore, in the case that the pressure in the combustion chamber is detected, the displacements of the pistons can be properly controlled based on the detected pressure of the current compression stroke (or the subsequent expansion stroke), so that the mixed gas is auto-ignited in the next compression stroke at the optimum timing. Namely the control device detects, based on the pressure in the combustion chamber, that the mixed gas has not been auto-ignited or the mixed gas has been auto-ignited at the improper timing, and controls the next compression stroke in which the above unfavorable operation (failure of the auto-ignition or the auto-ignition at the improper timing) may not be repeated.

Accordingly, a more favorable effect can be obtained in the case that the pressure in the combustion chamber is detected in addition to the temperature and the air-fuel ratio of the mixed gas.

According to a further feature of the present invention, each of the first and second drive means of the control device for the free piston engine comprises a (first and second) linear motor, which applies a thrust power by a magnetic force to the respective pistons so that the displacements of the pistons are controlled. Each of the linear motors converts kinetic energy of the pistons into electric energy to generate electric power. The displacements of the pistons are controlled with respect to the respective reference positions by adjusting the thrust powers to be applied to the pistons and/or oscillation frequency of the first and second linear motors.

According to the above control device for the free piston engine, the kinetic energy of the first and second pistons produced by explosion of the mixed gas can be converted into the electric energy at the respective linear motors, so that the electric power can be obtained. As a result that the free piston engine can be efficiently operated, the electrical power can be likewise efficiently generated.

According to a still further feature of the present invention, a specified physical quantity (or quantities) is detected to control the free piston engine, wherein a condition of the combustion in the engine can be estimated based on the specified physical quantity. According to a method for controlling the free piston engine, the displacements of the pistons with respect to the reference positions are controlled based on the detected physical quantity (or quantities), so that the mixed gas in the combustion chamber is auto-ignited at such a timing equal to or close to an end of the compression stroke, during which the pistons are moved closer to each other.

According to the feature of the present invention, at least one of the temperature of the mixed gas, the air-fuel ratio of the mixed gas, and the pressure in the combustion chamber is detected as the physical quantity (or quantities) to perform the above method for controlling the free piston engine.

BRIEF DESCRIPTION OF THE DRAWINGS

The above and other objects, features and advantages of the present invention will become more apparent from the following detailed description made with reference to the accompanying drawings. In the drawings:

FIG. 7 is a flowchart illustrating a controlling process executed by a control unit;

DETAILED DESCRIPTION OF THE EMBODIMENT

Figure 1:
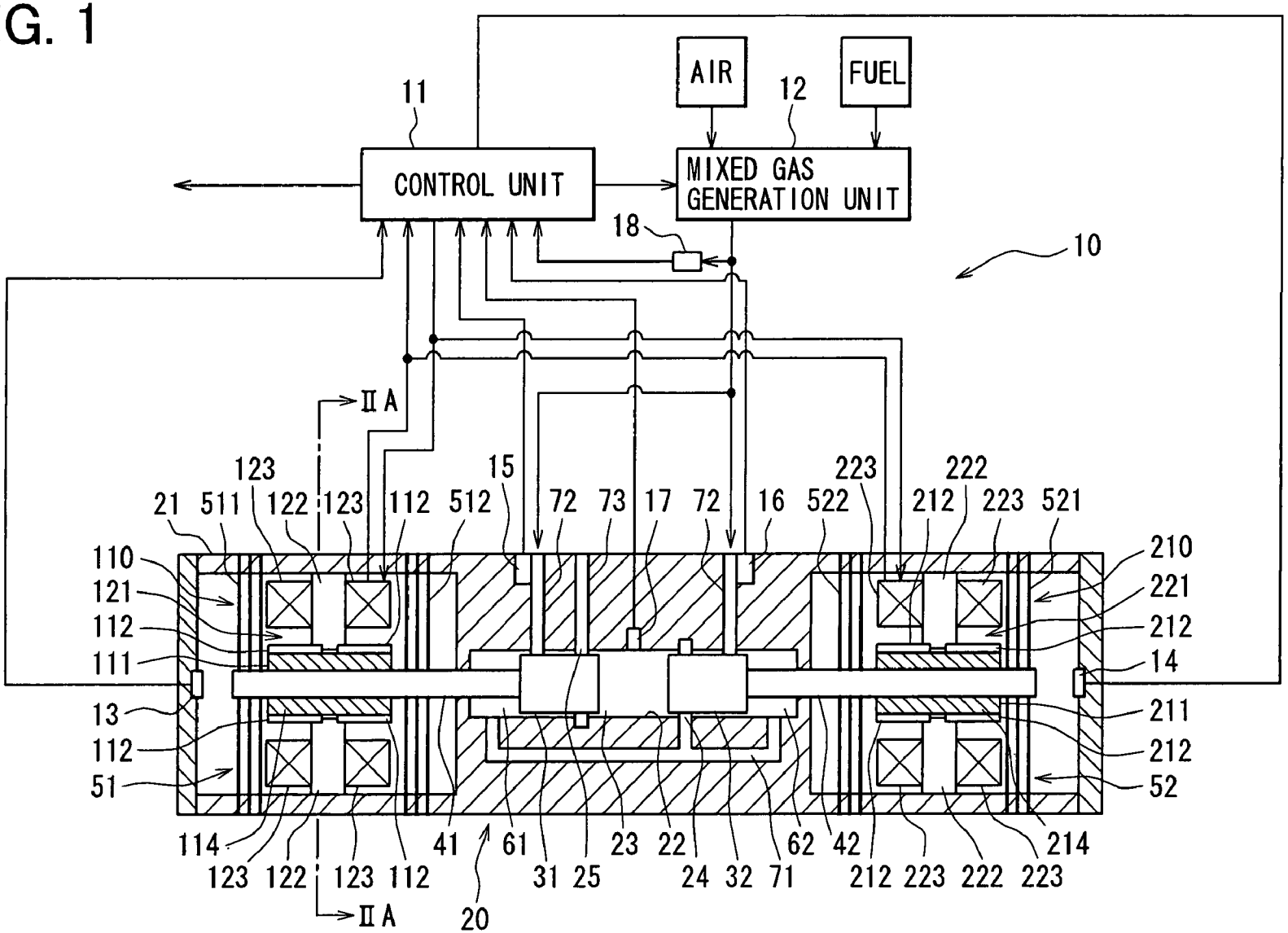
FIG. 1 is a schematic cross sectional view of an electric power generator of an embodiment of the present invention.

As shown in FIG. 1, an electric power generator 10 according to an embodiment of the present invention includes a free piston engine 20, a control unit 11, a mixed gas generation unit 12, a first linear motor 110, and a second linear motor 210. The control unit 11, which is mainly constructed by a microcomputer, controls the first and second linear motors 110 and 210 and the mixed gas generation unit 12 to operate the free piston engine 20 at an optimum state, so that electric power is generated at the linear motors 110 and 210.

The electric power generator 10 is connected with a motor or some other devices through, for example, an external battery (not shown). The power generator 10 is used as a power supply source for a small vehicle or a series-type hybrid vehicle.

The mixed gas generation unit 12 generates mixed gas of a predetermined air-fuel ratio from fuel and air. The control unit 11 controls the air-fuel ratio and an amount of the mixed gas to be supplied from the mixed gas generation unit 12 to the free piston engine 20. According to the present embodiment, gaseous fuel, such as hydrogen and methane, is used as the fuel for the free piston engine 20. In addition, combustible gas such as butane and propane and combustible liquid such as gasoline and diesel oil can be used as the fuel.

The free piston engine 20 includes a housing 21, a first piston 31, a second piston 32, a first shaft 41, a second shaft 42, a first plate spring unit 51 as a first spring means, and a second plate spring unit 52 as a second sprig means. The first piston 31, the first shaft 41, and the first plate spring unit 51 form a first oscillation system, whereas the second piston 32, the second shaft 42, and the second plate spring unit 52 form a second oscillation system.

The housing 21 forms a cylinder 22 with its internal surface of a tubular shape. The first piston 31 and the second piston 32 are accommodated in the cylinder 22, to be moveable back and forth in an axial direction of the cylinder 22. The pistons 31 and 32 are arranged to oppose to each other. The first shaft 41 is connected to the first piston 31 at a side opposite to a combustion chamber 23, whereas the second shaft 42 is connected to the second piston 32 at a side opposite to the combustion chamber 23. An end surface of the first piston 31 facing to the second piston 32, an end surface of the second piston 32 facing to the first piston 31, and the internal surface of the cylinder 22 form the combustion chamber 23. Thus, the volume of the combustion chamber 23 changes depending on the movement of the pistons 31 and 32. For example, the volume of the combustion chamber 23 decreases when the pistons 31 and 32 move closer to each other.

The combustion chamber 23 includes an intake opening 24 and an exhaust opening 25. A first auxiliary chamber 61 is formed between the first piston 31 and the housing 21 at a side of the first piston 31 opposite to the combustion chamber 23. A second auxiliary chamber 62 is formed between the second piston 32 and the housing 21 at a side of the second piston 32 opposite to the combustion chamber 23. An outer diameter of the respective pistons 31 and 32 is slightly smaller than an inner diameter of the housing 21 forming the cylinder 22. Therefore, the combustion chamber 23, the first auxiliary chamber 61, and second auxiliary chamber 62 are air tightly formed by the housing 21, the first piston 31, and the second piston 32.

The intake opening 24 is operatively connected with the mixed gas generation unit 12 through an intake passage 71, the first auxiliary chamber 61, the second auxiliary chamber 62, and intake passages 72. The mixed gas generated at the mixed gas generation unit 12 is operatively supplied from the intake opening 24 to the combustion chamber 23 through the passages. The exhaust opening 25 is operatively connected with the exterior of the free piston engine 20 through an exhaust passage 73. The intake opening 24 and the intake passages 71, 72 correspond to an intake means, and the exhaust opening 25 and the exhaust passage 73 correspond to an exhaust means.

The first plate spring unit 51 is connected with the first shaft 41 at the side of first piston 31 opposite to the combustion chamber 23. The spring unit 51 movably supports the first piston 31 and the first shaft 41 relative to the housing 21, allowing them to move back and forth in the axial direction. The spring unit 51 applies, to the first piston 31 and the first shaft 41, a biasing force which corresponds to a displacement of the first piston 31 and the first shaft 41 relative to a first reference position, in a direction opposite to a direction of the displacement. Therefore, the spring unit 51 pushes the first piston 31 and the first shaft 41 in a direction toward the side of the first piston 31 opposite to the combustion chamber 23 when the first piston 31 is at a position closer to the combustion chamber 23 (or closer to the second piston 32) relative to the first reference position. On the other hand, the spring unit 51 pushes the first piston 31 and the first shaft 41 in a direction toward the combustion chamber 23 when the first piston 31 is at a position more away from the combustion chamber 23 relative to the first reference position.

The second plate spring unit 52 is connected with the second shaft 42 at the side of second piston 32 opposite to the combustion chamber 23. The spring unit 52 movably supports the second piston 32 and the second shaft 42 relative to the housing 21, allowing them to move back and forth in the axial direction. The spring unit 52 applies, to the second piston 32 and the second shaft 42, a biasing force which corresponds to a displacement of the second piston 32 and the second shaft 42 relative to a second reference position in a direction opposite to a direction of the displacement. Therefore, the spring unit 52 pushes the second piston 32 and the second shaft 42 in a direction toward the side of the second piston 32 opposite to the combustion chamber 23 when the second piston 32 is at a position closer to the combustion chamber 23 (or closer to the first piston 31) relative to the second reference position. On the other hand, the spring unit 52 pushes the second piston 32 and the second shaft 42 to the combustion chamber 23 when the second piston 32 is at a position more away from the combustion chamber 23 relative to the second reference position.

In FIG. 1, the first piston 31 and first shaft 41 are at the first reference position. The first reference position is a central position (or an original position) of the back-and-forth movement of the first piston 31 and the first shaft 41. In FIG. 1, the second piston 32 and second shaft 42 are at the second reference position. The second reference position is a central position (or an original position) of the back-and-forth movement of the second piston 32 and the second shaft 42. The displacement of the first piston 31 and the first shaft 41 relative to the first reference position is referred to as a first displacement, whereas the displacement of the second piston 32 and the second shaft 42 relative to the second reference position is referred to as a second displacement.

The first plate spring unit 51 includes a group 511 of springs and another group 512 of springs, which are attached to two different positions of the first shaft 41 along the axial direction of the first shaft 41. The second plate spring unit 52 includes a group 521 of springs and another group 522 of springs, which are attached to two different positions of the second shaft 42 along the axial direction of the second shaft 42.

Each of the spring groups 511, 512, 521, and 522 includes a plurality of plate springs which are generally laminated in parallel with each other. The first spring unit 51 is firmly fixed to the first shaft 41 and the housing 21. The second spring unit 52 is likewise firmly fixed to the second shaft 42 and the housing 21.

The first and second spring units 51 and 52 respectively allow the first and second shafts 41 and 42 to move in the axial direction thereof, but restrict movements of the first and second shafts 41 and 42 in the radial direction thereof and rotations of the first and second shafts 41 and 42 in the circumferential direction thereof.

Inclinations of the first and second shafts 41 and 42 are suppressed, with respect to the axial direction, by supporting each of them at two different positions along its axial direction. In addition, it is possible to reduce the number of the plate springs for each spring group, because multiple spring groups constitute each of the spring units 51 and 52. Then, a high degree of manufacturing accuracy is not required for the plate springs and the number of work units for manufacturing the plate springs is reduced.

Figure 2A:
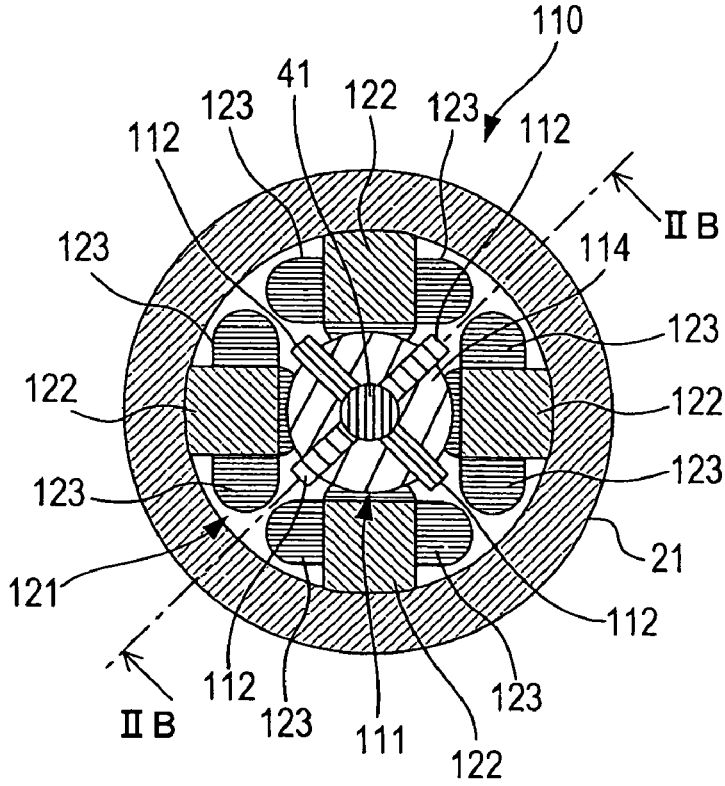
FIG. 2A is a cross sectional view of a first linear motor taken along a line IIA-IIA of FIG. 1.
Figure 2B:
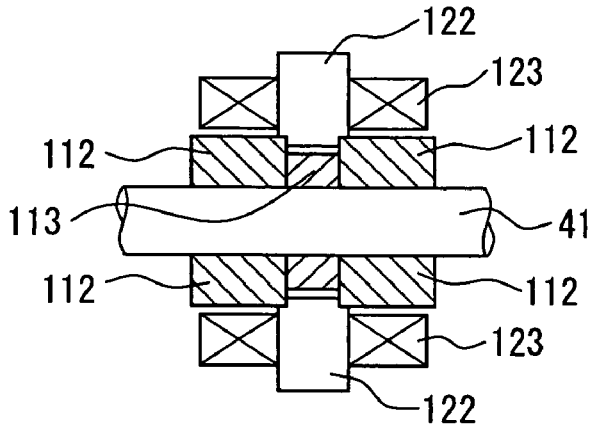
FIG. 2B is a cross sectional view taken along a line IIB-IIB of FIG. 2A.

The first linear motor 110 includes a first movable unit 111 and a first fixed unit 121. The first movable unit 111 is attached to the first shaft 41, which is made of nonmagnetic material, and moves back and forth in the axial direction along with the first shaft 41. As shown in FIGS. 2A and 2B, the first movable unit 111 includes a magnetized core 114 which comprises multiple (eight) arc-shaped core pieces, a ring-shaped nonmagnetic spacer 113 as a magnetism blocking means, and multiple (eight) permanent magnets 112 which are arranged at both sides of the spacer 113 in the moving direction of the first shaft 41 and between the neighboring core pieces. The permanent magnets 112 are attached to the first shaft 41 and extend in a radial direction from the first shaft 41. In addition, as shown in FIG. 1, the first movable unit 111 is arranged between the spring groups 511 and 512 in the axial direction of the first shaft 41.

The first fixed unit 121 is formed to surround the first movable unit 111. The first fixed unit 121 includes multiple coils 123, each of which is respectively fixed to yokes 122. The yokes 122 are fixed to the housing 21.

The second linear motor 210 has the same structure to that of the first linear motor 110, and includes a second movable unit 211 and a second fixed unit 221. The second movable unit 211 includes a magnetized core 214, a nonmagnetic spacer (not illustrated) like the spacer 113 as a magnetism blocking means, and permanent magnets 212. The second movable unit 211 is arranged between the spring groups 521 and 522 in the axial direction of the second shaft 42.

The second fixed unit 221 is likewise formed to surround the second movable unit 211. The second fixed unit 221 includes multiple coils 223, each of which is respectively fixed to yokes 222. The yokes 222 are fixed to the housing 21.

The yokes 122, 222 and the housing 21 may be constructed as a single body. The permanent magnets 112, 212 and the (first and second) shaft 41, 42 may be constructed as a single body, by magnetizing a part of the nonmagnetic (first and second) shaft 41, 42.

The above linear motors 110 and 210 are described more in detail in, for example, Japanese Patent Publication No. 2004-88884.

The first fixed unit 121 (the coils 123) and the second fixed unit 221 (the coils 223) are electrically connected with the control unit 11.

The control unit 11 supplies the external battery (not shown) with the electrical power outputted by the fixed units 121 and 221, when the electrical power is generated at the fixed units 121 and 221, that is, when the linear motors 110 and 210 operate as an electric power generator.

On the other hand, the control unit 11 supplies the fixed units 121 and 221 with the electrical power stored in the external battery, to generate a driving force at the linear motors 110 and 210 to apply the driving force to the pistons 31 and 32, that is, to operate the linear motors 110 and 210 as normal linear motors.

Position sensors 13 and 14 are provided at predetermined positions of the free piston engine 20, for respectively detecting the position of the first piston 31 and the second piston 32.

Figure 5A:
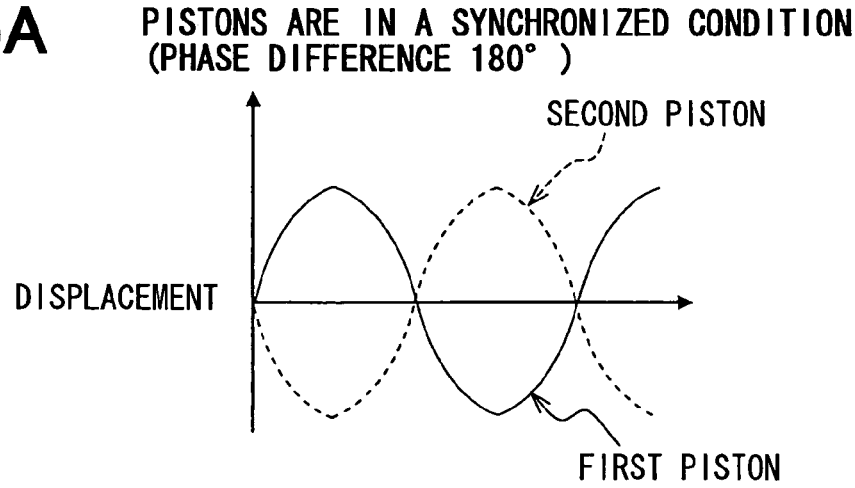
FIGS. 5A and 5B are graphs respectively illustrating a displacement of a first piston and a second piston.
Figure 5B:
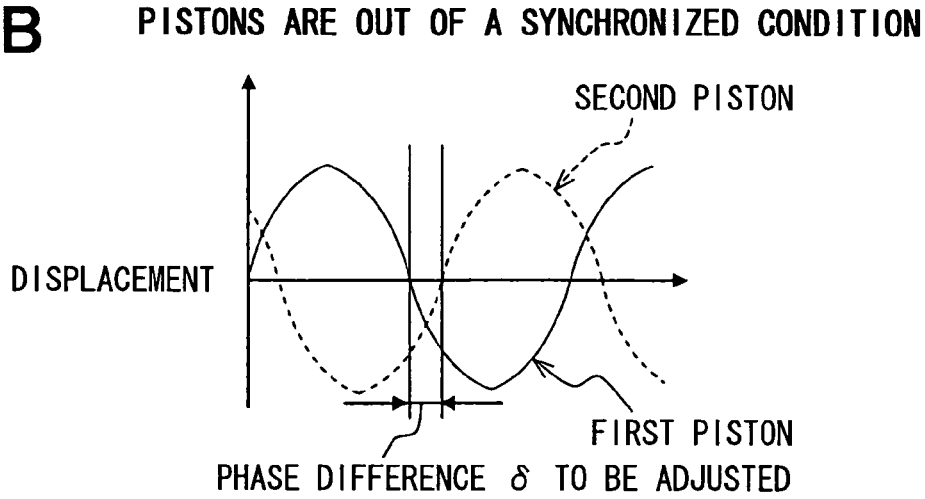

The position sensor 13 detects the first displacement of the first shaft 41 by means of, for example, light, magnetism, or capacitance and outputs a voltage signal depending on the first displacement as a first displacement signal, as shown by solid lines in FIGS. 5A and 5B indicating the first displacement. The position sensor 14 detects the second displacement of the second shaft 42 in the same manner as the position sensor 13 and outputs a voltage signal depending on the second displacement as a second displacement signal, as shown by dashed lines in FIGS. 5A and 5B, indicating the second displacement. The first and second displacement signals are inputted into the control unit 11 from the position sensors 13 and 14. In FIG. 5A, the first piston 31 is synchronized with the second pistons 32, and amounts of the first and second displacements are the same to each other and a phase difference between the first and second pistons 31 and 32 is at the optimum value of 180 degrees, that is, the pistons 31 and 32 are in the opposite phase. In FIG. 5B, the first piston 31 has become out of synchronization from the second piston 32, namely the phase difference is varied by a value δ from the optimum value of 180 degrees.

Temperature sensors 15 and 16 are provided in the intake passages 72 of the free piston engine 20, for detecting a temperature of the mixed gas to be supplied from the mixed gas generation unit 12 to the combustion chamber 23. The mixed gas is also referred to as premixed gas. Detection signals outputted from the temperature sensors 15 and 16 are inputted into the control unit 11. The temperature sensors 15 and 16 may be attached to the intake passage 71 or the first, or the second auxiliary chamber 61 or 62. Only a single temperature sensor may be attached to the free piston engine 20.

A pressure sensor 17 is provided at a predetermined position of a sidewall of the housing 21 forming the combustion chamber 23, for detecting a pressure in the combustion chamber 23. A detection signal outputted from the pressure sensor 17 is also inputted into the control unit 11.

An air-fuel ratio sensor 18 is provided in a supply path of the premixed gas from the mixed gas generation unit 12 to the intake passages 72 for detecting air-fuel ratio of the premixed gas. A detection signal outputted from the air-fuel ratio sensor 18 is likewise inputted into the control unit 11.

Hereafter, an operation of the electric power generator 10 will be described. At first, an operation of the free piston engine 20 will be described. The engine 20 is a two-stroke engine. Therefore, a scavenging stroke for an intake and exhaust processes and a combustion stroke for a compression and combustion processes are performed, while the pistons 31 and 32 move back and forth once. The free piston engine 20 repeats the above scavenging stroke and the combustion stroke. A position for the pistons 31 and 32 is referred to as a top dead center when the pistons come to the closest position to each other and thereby the volume of the combustion chamber 23 becomes to its minimum value, that is, when the compression process comes to an end. On the other hand, a position for the pistons 31 and 32 is referred to as a bottom dead center when the pistons move away from the combustion chamber 23 and come to the farthest point from each other. The actual positions of the top dead center and the bottom dead center vary, because the maximum value of the first and the second displacements of the pistons 31 and 32 varies depending on the condition of the operation of the engine 20.

Figure 3:
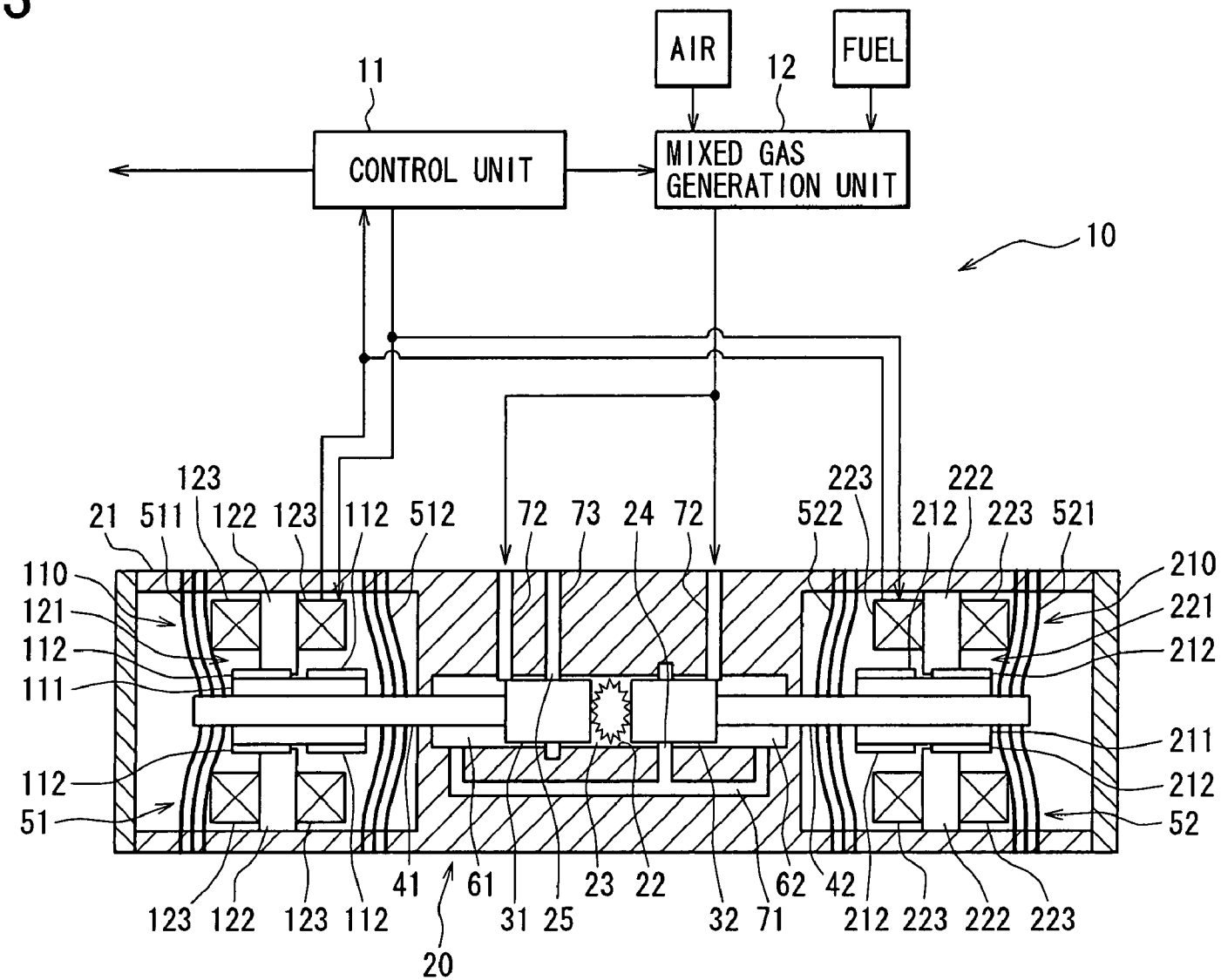
FIG. 3 is a schematic cross sectional view of the electric power generator illustrating an exhaust stroke.

As shown in FIG. 3, the mixed gas supplied into the combustion chamber 23 is compressed, when the first and second pistons 31 and 32 are moved toward its top dead center. The mixed gas is thereby compressed to high temperature and high pressure gas, and finally auto-ignited.

During the above operation, the control unit 11 controls thrust powers to be applied to the first and second pistons 31 and 32 by the first and linear motors 110 and 210, as well as oscillation frequencies of the first and second linear motors 110 and 210. As a result, the control unit 11 controls the first and second displacements of the pistons 31 and 32, so that the mixed gas is compressed at such a compression ratio, at which the compressed mixed gas can be auto-ignited, when the pistons 31 and 32 reach the position of the top dead center.

Figure 4:
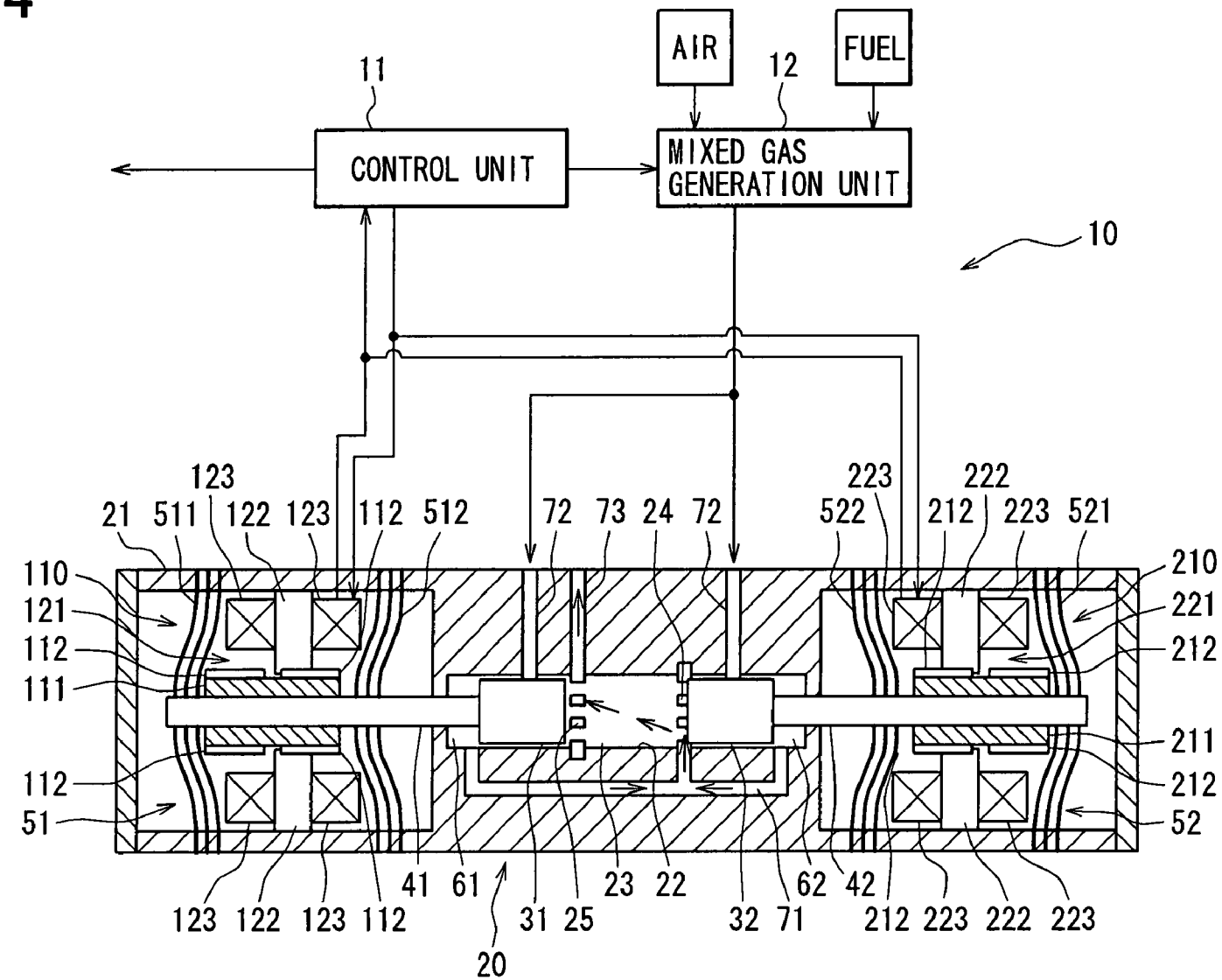
FIG. 4 is a schematic cross sectional view of the electric power generator illustrating an exhaust stroke.

The sensors 13 to 18 as well as signal lines from the sensors to the control unit 11 are omitted from the drawing of FIGS. 3 and 4.

According to the above embodiment, a timing of the auto-ignition of the mixed gas in the combustion chamber 23 is selected as such a timing, at which the pistons 31 and 32 reach the top dead center. However, the timing for the auto-ignition may be set at such a predetermined timing, which is adjacent to but in advance to the top dead center depending on the structure of the pistons, and at which fuel energy can be most efficiently converted into a driving force for driving the pistons 31 and 32.

The movements of the pistons 31 and 32 to the top dead center increase the volumes of the first and second auxiliary chambers 61 and 62 to reduce the pressures thereof. Therefore, the mixed gas generated in the mixed gas generation unit 12 is sucked into the auxiliary chambers 61 and 62 through the intake passages 72.

When the mixed gas is auto-ignited, the pressure in the combustion chamber 23 is rapidly increased. Combusted gas made by the combustion is expanded in the combustion chamber 23 and pushes the pistons 31 and 32 toward the bottom dead center. Thus, the pistons 31 and 32 are moved toward the bottom dead center by the driving force generated from the expansion (or explosion) of the combustion gas. The movements of the pistons 31 and 32 to the bottom dead center increase the volume of the combustion chamber 23 and reduce the pressure thereof.

On the other hand, as shown in FIG. 4, when the pistons 31 and 32 are moved to the bottom dead center, the volumes of the auxiliary chambers 61 and 62 are reduced to increase the pressures thereof. Therefore, the mixed gases in the auxiliary chambers 61 and 62 are forced to enter into the combustion chamber 23 through the intake passage 71.

At this time, the first and second shafts 41 and 42 are moved in the directions opposite to the combustion chamber 23, along with the movements of the pistons 31 and 32 to the bottom dead center. Therefore, the first and second plate spring units 51 and 52 are elastically deformed to store energies for pushing back the shafts 41 and 42 toward the combustion chamber 23.

The pistons 31 and 32 are pushed back toward the combustion chamber 23 along with the shafts 41 and 42 by the energies stored in the spring units 51 and 52, when the pistons 31 and 32 have reached at the bottom dead center. Then, the mixed gas supplied into the combustion chamber 23 is compressed, whereas the combusted gas staying in the combustion chamber 23 is exhausted to the outside of the engine 20 through the exhaust passage 73.

As shown in FIG. 4, the intake opening 24 and the exhaust opening 25 are arranged asymmetrically relative to the center along the axial direction of the cylinder 22. More specifically, the exhaust opening 25 is formed at a position closer to the center of the cylinder 22 than the intake opening 24. Therefore, when the amounts of the first and second displacements of the first and second pistons 31 and 32 are the same, the exhaust opening 25 will be opened to the combustion chamber 23 earlier than the intake opening 24 in the combustion stroke and will be closed later than the exhaust opening 25 in the scavenging stroke. As a result, a one-way flow of the gas is formed in the combustion chamber 23 from the intake opening 24 to the exhaust opening 25 in the scavenging stroke. Namely, a uni-flow scavenging operation is achieved in the combustion chamber 23, so that an amount of residual combustion gas is reduced in the combustion chamber 23.

A fresh mixed gas supplied in the combustion chamber 23 will be auto-ignited again when the pistons 31 and 32 reach the top dead center again. The free piston engine 20 continues its operation by repeating the above processes. As shown in FIG. 5A, the pistons 31 and 32 are controlled so that their amounts of the displacements are the same to each other and they are in the opposite phase, that is, the phase difference of their back-and-forth movements are 180 degrees.

Next, an operation of the first and second linear motors 110 and 210 is described.

The first shaft 41 connected with the first piston 31 and the second shaft 42 connected with the second piston 32 are moved back and forth along with the movements of the pistons 31 and 32, respectively. Thus, the first movable unit 111 attached to the first shaft 41 moves relative to the first fixed unit 121, whereas the second movable unit 211 attached to the second shaft 42 moves relative to the second fixed unit 221. The magnetic fields around the fixed units 121 and 221 are changed in accordance with the relative movement between the first movable unit 111 and the first fixed unit 121 and the relative movement between the second movable unit 211 and the second fixed unit 221. As a result, the fixed units 121 and 221 generate the electric power. The electric power generated at the fixed units 121 and 221 is stored in the battery through the control unit 11. This is the mechanism of the power generation of the electric power generator.

The control unit 11 detects the condition of the operation of the free piston engine 20 by means of the signals from the sensors 13 to 18, in order to control the mixed gas generation unit 12 according to the result of the detection, and to control most properly the displacements (specifically amplitudes of the back-and-force movements), by means of the electrical currents to be supplied to the first and second fixed units 121 and 221 (the coils 123 and 223).

The fixed units 121 and 221 generate magnetic fields around themselves when the electric current is supplied to the fixed units 121 and 221 from the control unit 11. When the magnetic fields are generated, magnetic forces are applied between the first fixed unit 121 and the first movable unit 111 and between the second fixed unit 221 and the second movable unit 211, and the magnetic forces are operated as thrust power (driving forces) from the linear motors 110 and 210 to the pistons 31 and 32. The thrust power of the linear motors 110 and 210 can be adjusted by changing the amount of the electric currents to the fixed units 121 and 221.

For example, the spring forces of the spring units 51 and 52 may become, as the case may be, insufficient for pushing back the pistons 31 and 32, when the pistons 31 and 32 compress the mixed gas in the combustion chamber 23. In this case, the control unit 11 can adjust the first and second displacements of the pistons 31 and 32 by supplying the electric currents to the fixed units 121 and 221 and adjusting the thrust power of the linear motors 110 and 210 to the pistons 31 and 32 under the control of the amount of the electric currents to the fixed units 121 and 221.

Figure 6:
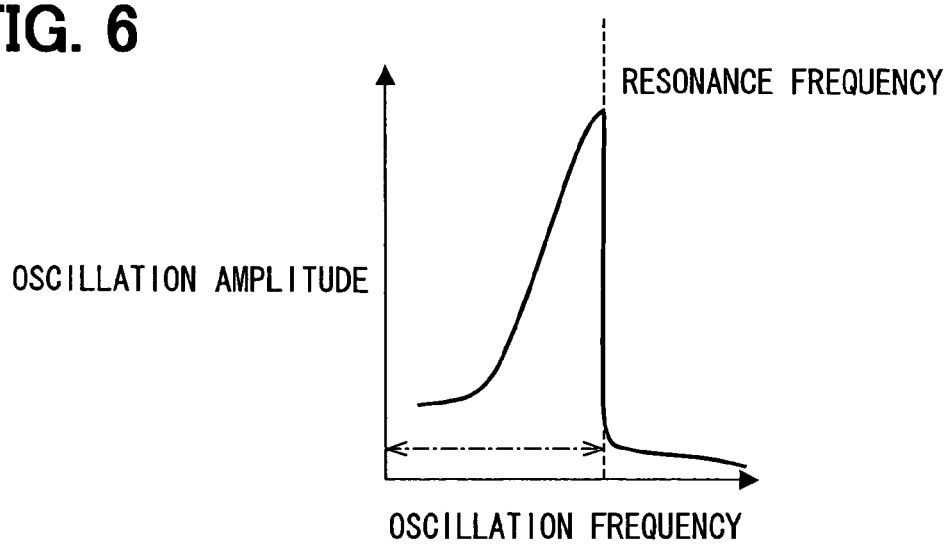
FIG. 6 is a graph illustrating a relation between an oscillation magnitude of the piston and an oscillation frequency of the linear motor.

Moreover, the spring units 51 and 52 of the first and second oscillation systems are nonlinear springs. As shown in FIG. 6, the amplitude of the oscillation of the pistons 31 and 32 become smaller when the frequency of the thrust power of the linear motors 110 and 210 is reduced, in a frequency range smaller than a resonance frequency of the first and second oscillation systems. The frequency of the thrust power corresponds to the frequency of the electric current supplied to the fixed units 121 and 221 and also corresponds to an oscillation frequency of the linear motors 110 and 210.

On the other hand, the oscillation amplitude of the pistons 31 and 32 becomes larger, when the oscillation frequency of the linear motors 110 and 210 becomes larger and closer to the resonance frequency of the first and second oscillation systems, in the frequency range smaller than the resonance frequency. Therefore, the control unit 11 can adjust the first and second displacements of the pistons 31 and 32 by changing the oscillation frequency of the linear motors 110 and 210.

Next, a control process is described, according to which the control unit 11 controls the displacements of the pistons 31 and 32 so that the phase difference between the first and second displacements is maintained at 180 degrees and that the mixed gas is controlled at the compression ratio sufficient for the auto-ignition when the pistons 31 and 32 come to the top dead center.

FIG. 7 is a flow chart showing the control process to be carried out by the control unit 11. The control process of FIG. 7 is executed in each compression stroke, in which the pistons 31 and 32 come closer to each other.

When the control unit 11 starts executing the process of FIG. 7, the control unit 11 executes, at first at a step S110, a piston synchronization process for maintaining the phase difference of the pistons 31 and 32 at 180 degrees, as shown in FIG. 5A.

Figure 8:
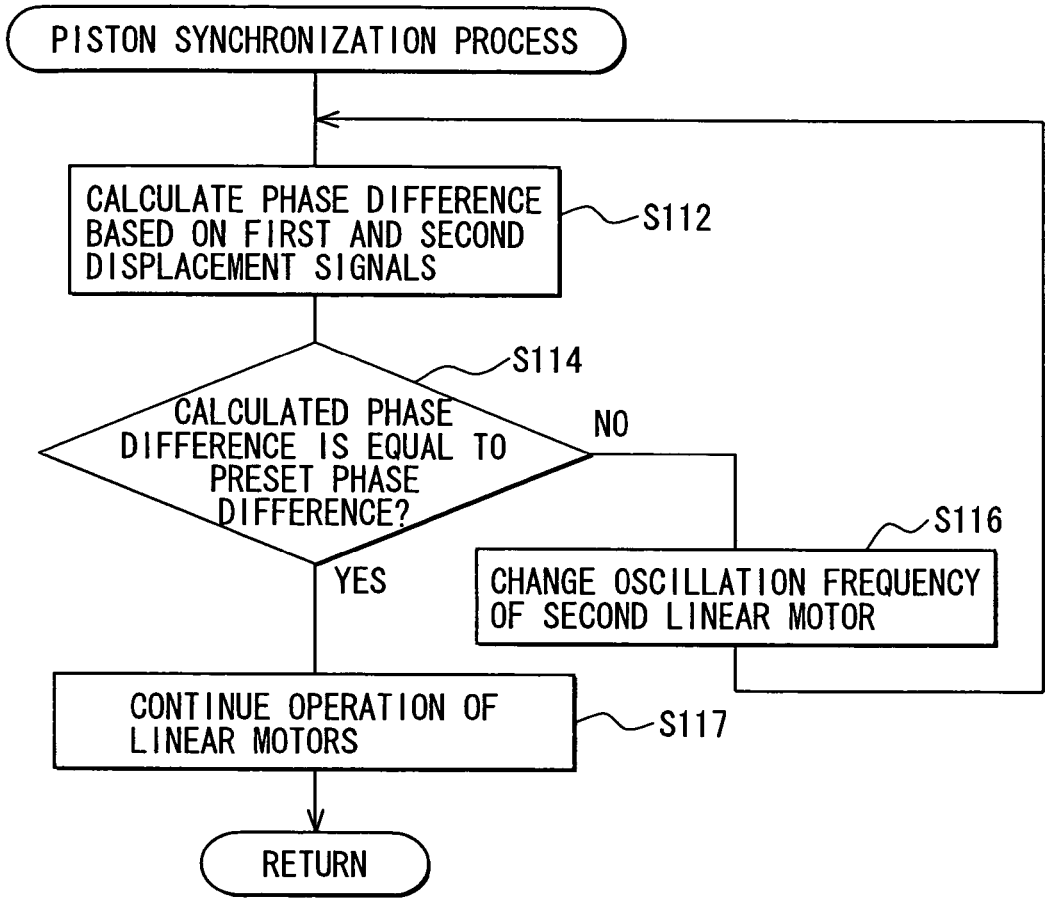
FIG. 8 is a flowchart illustrating a piston synchronization process executed in the controlling process.

In the piston synchronization process, as shown in FIG. 8, the control unit 11 reads out at first, at a step S112, the first and second displacement signals outputted from the position sensors 13 and 14, and calculates the phase difference between the pistons 31 and 32 according to the difference between the first and second displacement signals.

At a step S114, the control unit 11 determines whether the calculated phase difference is equal to a preset phase difference, that is, 180 degrees. In the case that the determination is NO (unequal) at the step S114, the process goes to a step S116. At the step S116, the control unit 11 changes the oscillation frequency of the second linear motor 210 so that the phase difference of the pistons 31 and 32 becomes equal to the preset phase difference, and then the process goes back to the step S112. More specifically, at the step S116, in the case that precedence of the phase of the second piston 32 causes the difference between the actual phase difference and the preset phase difference, the control unit 11 reduces the oscillation frequency of the second linear motor 210 to decelerate the second piston 32. In the case that delay of the phase of the second piston 32 causes the difference between the actual phase difference and the preset phase difference, the control unit 11 increases the oscillation frequency of the second linear motor 210 to accelerate the second piston 32.

In the case that the determination at the step S114 is YES (equal), the control unit 11 continues the current operation of the linear motors 110 and 210, at a step S117, and terminates the execution of the piston synchronization process. By executing the piston synchronization process, the control unit 11 can get the unsynchronized state as shown in FIG. 5B back to the synchronized state as shown in FIG. 5A.

When the piston synchronization process is terminated, the control unit 11 subsequently reads out, at a step S120 in FIG. 7, the signals from the temperature sensors 15 and 16 and the air-fuel ratio sensor 18, and detects the temperature and the air-fuel ratio of the premixed gas. The control unit 11 sums up the two temperatures from the temperature sensors 15 and 16, divides the summed value by two, and makes the divided value as the detected temperature of the premixed gas.

Figure 9A:
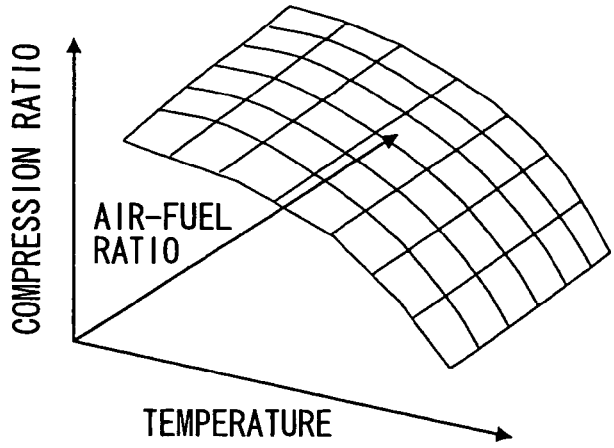
FIGS. 9A to 9C are graphs illustrating a three dimensional data map for calculating a necessary compression ratio from a temperature and an air-fuel ratio of mixed gas.

Next at a step S130, the control unit 11 calculates a compression ratio (hereafter referred to as a necessary compression ratio) necessary for the auto-ignition of the mixed gas in the combustion chamber 23 when the pistons 31 and 32 have reached at the top dead center, by applying the detected temperature and air-fuel ratio to a three dimensional data map shown in FIG. 9A.

The necessary compression ratio for the auto-ignition to be caused by the compression changes depending on the temperature of the premixed gas at the start of the compression and the air-fuel ratio of the premixed gas. Therefore, the auto-ignition of the mixed gas cannot be always and surely carried out at the timing that the pistons 31 and 32 have reached at the top dead center, if the free piston engine 20 is always operated with a constant compression ratio. This operation would not realize an efficient operation of the free piston engine 20.

According to the present embodiment, therefore, the three dimensional data map (as shown in FIG. 9A) representing a relation among the temperature, the air-fuel ratio, and the necessary compression ratio is prepared beforehand by experiments, and stored in a storage device such as a ROM. The necessary compression ratio, which corresponds to the temperature and the air-fuel ratio of the current premixed gas, can be calculated from such three dimensional data map.

Figure 9B:
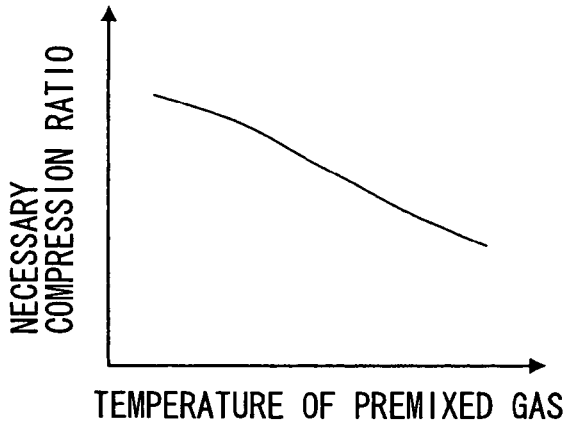
Figure 9C:
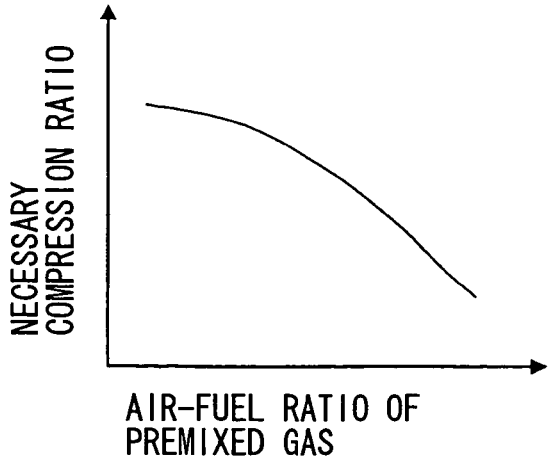

The three dimensional data map is so made that the necessary compression ratio gets smaller as the temperature of the premixed gas gets larger as shown in FIG. 9B, and that the necessary compression ratio gets smaller as the temperature the premixed gas gets larger as shown in FIG. 9C. This is because the mixed gas is auto-ignited at a lower pressure as the temperature of the premixed gas at the start of the compression process is higher and the air-fuel ratio is larger.

Figure 10:
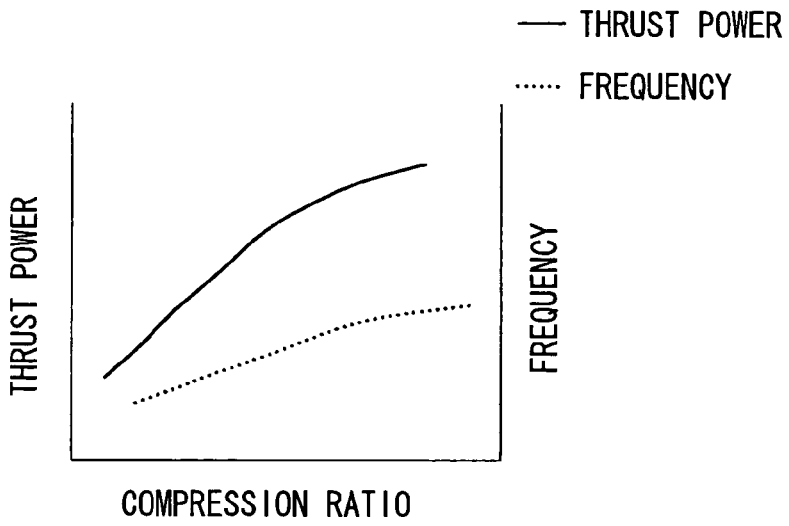
FIG. 10 is a graph illustrating a two dimensional data map for calculating a necessary thrust power and a necessary oscillation frequency of the linear motor from the necessary compression ratio.

At a step S140, by applying the calculated necessary compression ratio to a two dimensional data map shown in FIG. 10, the control unit 11 calculates a thrust power (hereafter referred to as a necessary thrust power) and an oscillation frequency (hereafter referred to as a necessary oscillation frequency) of the linear motors 110 and 210, which are necessary for the auto-ignition at the timing that the pistons 31 and 32 come to the top dead center.

The two dimensional data map represents relationships between the compression ratio and the thrust power as well as the oscillation frequency, to achieve the compression ratio. The two dimensional data map is prepared beforehand by experiments and stored in the storage device such as the ROM. As shown in FIG. 10, the two dimensional data map is so made that the necessary thrust power and oscillation frequency get larger as the necessary compression ratio gets larger. This is because the larger compression ratio requires the larger displacements of the pistons 31 and 32 which are achieved by the larger thrust power and oscillation frequency of the linear motors 110 and 210.

At a step S150, the control unit 11 determines whether a previous combustion is made in a good condition, according to a result of a combustion condition determination process described later in connection with FIG. 11. If the determination is NO (not good) at the step S150, the process goes to a step S160.

At the step S160, the control unit 11 determines, according to the result of the combustion condition determination process (FIG. 11), whether the combustion at the previous compression process was carried out earlier than the optimum timing, that is, whether the mixed gas has been auto-ignited before the both pistons 31 and 32 reach at the top dead center. In the case that the determination at the step S160 is YES (the auto-ignition timing is earlier), the process goes to a step S170, at which the necessary thrust power and oscillation frequency calculated at the step S140 are corrected to decrease by predetermined amounts, in order that the compression ratio becomes smaller, that is, the displacements of the pistons 31 and 32 become smaller. Then, the process goes to a step S180.

In the case that the determination at the step S160 is NO, that is, the auto-ignition timing of the previous combustion was made later than the optimum timing, the control unit 11 subsequently executes a step S175. At the step S175, the necessary thrust power and oscillation frequency calculated at the step S140 are corrected to increase by predetermined amounts, in order that the compression ratio becomes larger, that is, the displacements of the pistons 31 and 32 become larger. Then, the process goes to the step S180.

In the case that the determination at the step S150 is YES (the previous combustion: good condition); the control unit 11 executes the step S180 without correcting the calculated necessary thrust power and oscillation frequency.

At the step S180, the control unit 11 determines whether the current thrust power and oscillation frequency of the linear motors 110 and 210 are equal to the necessary thrust power and oscillation frequency calculated at the steps S140, S170, and S175. If the determination is YES (equal) at the step S180, the control unit 11 continues the current operation of the linear motors 110 and 210, at a step S190, and terminates the process of FIG. 7.

In the case that the determination at the step S180 is NO (unequal), the control unit 11 changes, at a step S195, the current thrust power and oscillation frequency to the necessary thrust power and oscillation frequency calculated at the steps S140, S170, and S175. Then, the control unit 11 terminates the controlling process of FIG. 7.

Figure 11:
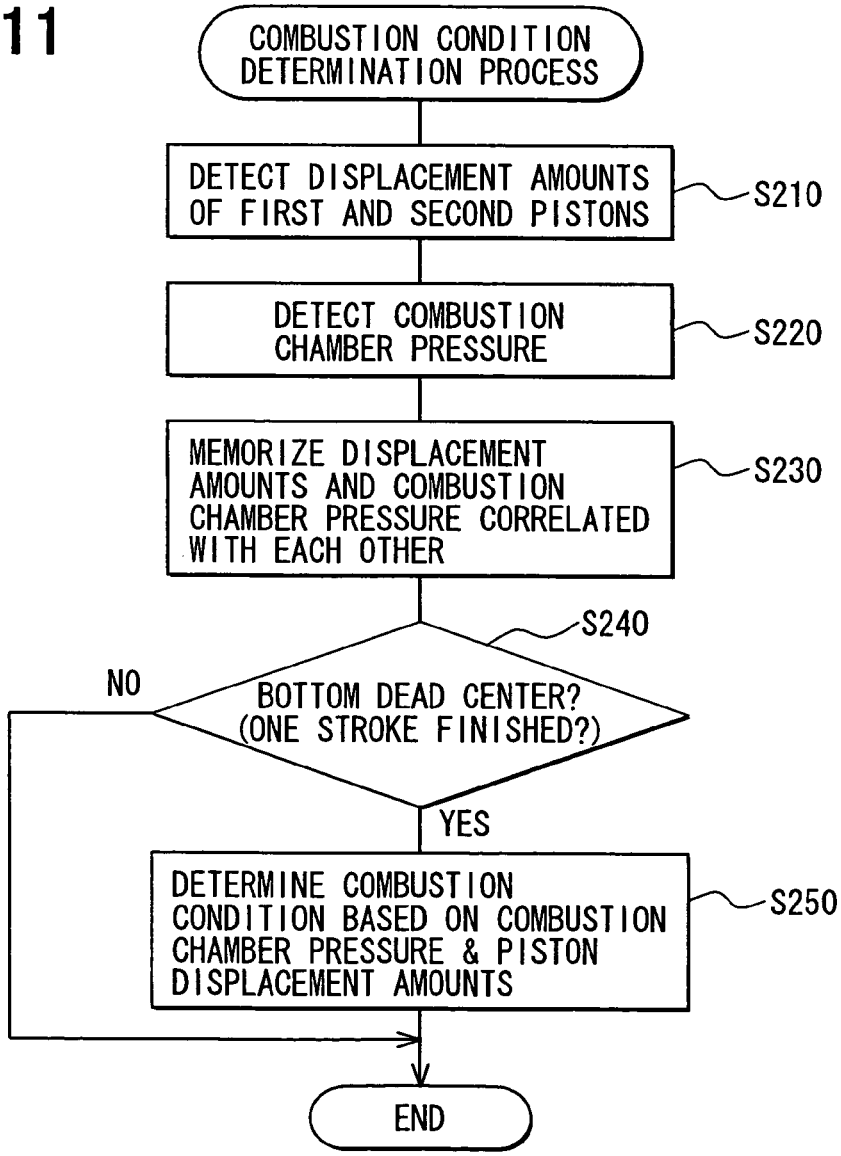
FIG. 11 is a flowchart illustrating a combustion state determination process executed by the control unit.

The control unit 11 concurrently executes the combustion condition determination process of FIG. 11, with the control process of FIG. 7. The combustion condition determination process is periodically and constantly executed in a predetermined sampling period, which is sufficiently smaller than a minimum period in which each of the pistons 31 and 32 makes one back-and-force movement.

As shown in FIG. 11, in the combustion condition determination process, the control unit 11 respectively detects, at first at a step S210, the amounts of the displacements of the pistons 31 and 32 according to the displacement signals from the position sensors 13 and 14. At a step S220, the control unit 11 detects the pressure (hereafter referred to as a combustion chamber pressure) in the combustion chamber 23 according to the signal from the pressure sensor 17. At a step S230, the control unit 11 stores the amounts of the displacements detected at the step S210 and the pressure detected at the step S220 into a working memory such as a RAM, by correlating them with each other.

At a step S240, the control unit 11 determines, according to the detection of the step S210, whether the pistons 31 and 32 come to the bottom dead center as shown in FIG. 4, that is, whether one stroke is completed. In the case that the determination at the step S240 is NO (not at the bottom dead center), the control unit 11 temporally terminates the combustion condition determination process.

By executing the steps S210 to S240 in every sampling period, every pressure of the combustion chamber 23 detected in the respective sampling timings of one stroke, which starts when the pistons 31 and 32 come to the bottom dead center and ends when they come to the bottom dead center again, is stored into the work memory, wherein the respective pressures of the combustion chamber 23 are correlated with the respective displacement amounts of the pistons 31 and 32 detected at the sampling timings.

In the case that the determination at the step S240 is YES (one stroke has been ended), the process goes to a step S250, at which the combustion condition of the last compression stroke is determined, by analyzing the pressure in the combustion chamber and the displacement amounts of the pistons 31 and 32 in the last compression stroke stored in the work memory.

Figure 12:
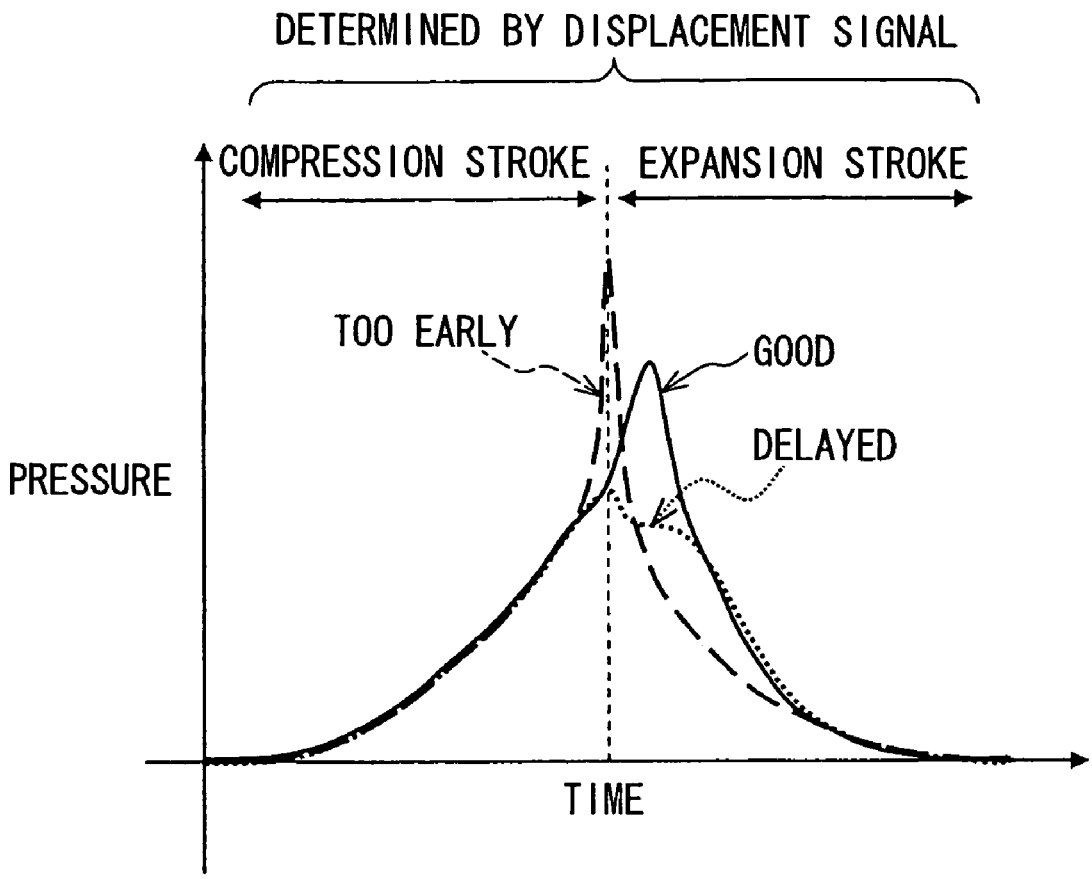
FIG. 12 is a graph illustrating a method for determining the combustion state.

More specifically, the control unit 11 determines, at the step S250, that the combustion was carried out in a good condition, as shown by a solid line in FIG. 12, in the case that a peak of the combustion chamber pressure appears, which is larger than a predetermined pressure, slightly after the end of the compression strokes, that is, slightly after the pistons 31 and 32 reach at the top dead center.

On the other hand, the control unit 11 determines at the step S250 that the combustion condition was not good, namely the combustion timing (i.e. the timing of the auto-ignition) was made earlier than the optimum combustion timing, when the peak of the combustion chamber pressure has appeared slightly before or just at the end of the compression stroke, as shown by a dashed line in FIG. 12.

Moreover, the control unit 11 also determines at the step S250 that the combustion condition was not good, namely the combustion timing (the timing of the auto-ignition) was made later than the optimum combustion timing, when the peak of the combustion chamber pressure has appeared once at the end of the compression stroke and another pressure change has appeared in a pressure increasing direction during the expansion stroke following the compression stroke, (that is, in the stroke in which the pistons 31 and 32 are moved apart), as indicated by a curved dotted line in FIG. 12.

Subsequently to the step S250, the control unit 11 temporally terminates the combustion condition determination process of FIG. 11. The result of the determination at the step S250 is used at the steps S150 and S160 of FIG. 7.

As above, the electric power generator 10 detects (at the steps S120 and S220) the temperature of the premixed gas, the air-fuel ratio of the premixed gas, and the combustion chamber pressure as physical quantities, by which the condition of the combustion of the free piston engine 20 can be estimated.

Then, based on the result of the detection, the electric power generator 10 controls (at the steps S130-S195 and S250) the first and second displacements of the pistons 31 and 32, by the thrust power and the oscillation frequency of the linear motors 110 and 210, so that the mixed gas in the combustion chamber 23 is compressed at such a compression ratio, with which the compression ratio at which the mixed gas is auto-ignited at the optimum timing for efficiently converting the energy of the fuel into the driving force of the pistons 31 and 32 (that is, at the timing corresponding to the end of the compression stroke where the pistons 31 and 32 come closest to each other, according to the present embodiment).

The above optimum timing for the auto-ignition can be realized in the following manner. For example, the premixed gas in the combustion chamber 23 tends to auto-ignite earlier, that is, tends to auto-ignite even with a smaller compression ratio, as the temperature of the premixed gas becomes higher and/or the air-fuel ratio of the premixed gas becomes larger. In this case, the electric power generator 10 adjusts the timing of the ignition to meet the optimum timing by reducing the compression ratio, which is achieved by reducing the oscillation frequencies of the linear motors 110 and 210 below the resonance frequencies of the oscillation systems and thus reducing the amounts of displacements of the pistons 31 and 32.

On the other hand, the premixed gas in the combustion chamber 23 tends to be more difficult to auto-ignite, that is, tends to be more difficult to auto-ignite even with a larger compression ratio, as the temperature of the premixed gas becomes lower and/or the air-fuel ratio of the premixed gas becomes smaller. In this case, the electric power generator 10 adjusts the timing of the ignition to meet the optimum timing by increasing the compression ratio, which is achieved by increasing the thrust power of the linear motors 110 and 210, while maintaining the oscillation frequencies of the linear motors 110 and 210 at the resonance frequencies of the oscillation systems, so that the amounts of displacements of the pistons 31 and 32 are increased. The above controls based on the temperature and the air-fuel ratio of the premixed gas are achieved by executing the steps S120 to S140 and S180 to S195.

As above, the displacements of the pistons 31 and 32 can be controlled by detecting the temperature and/or the air-fuel ratio of the mixed gas in the compression stroke in order that the mixed gas auto-ignites at the optimum timing in the compression stroke. In other words, the control unit 11 can forestall that the mixed gas fails to auto-ignite or that the mixed gas auto-ignites at such a timing at which a high efficient operation can not be obtained.

Even if the auto-ignition timing of the premixed gas deviates from the optimum timing, such deviation is detected based on the combustion chamber pressure in the combustion condition detection process of FIG. 11. In the following compression stroke, the displacements of the pistons 31 and 32 are controlled by the process at the steps S150 to S175 so that the compression ratio of the premixed gas is controlled at such a value at which the mixed gas can be auto-ignited at the optimum timing. Thus, even if the ignition timing cannot be maintained at the optimum timing due to any reasons, despite the control based on the temperature and the air-fuel ratio of the premixed gas, such an unfavorable combustion is detected based on the combustion chamber pressure and avoided in the subsequent compression strokes.

Therefore, according to the above control process of the electric power generator 10, it is possible to surely avoid an inefficient combustion, in which the mixed gas is ignited before the optimum ignition timing or the mixed gas is not ignited even when the compression stroke ends and the pistons 31 and 32 start getting away from each other.

Accordingly, the control unit 11 can efficiently transform the energy of the fuel to the driving force for the pistons 31 and 32 and constantly operate the free piston engine 20 at a high efficiency. The efficient operation of the free piston engine 20 provides the efficient electric power generation.

The present invention should not be limited to the embodiment discussed above and shown in the figures, but may be implemented in various ways without departing from the spirit of the invention.

For example, the control unit 11 may detect any one or two of the temperature of the premixed gas, the air-fuel ratio of the premixed gas, and the combustion chamber pressure, and may control the amounts of the displacements of the pistons 31 and 32 according to the detected quantities.

More specifically, in a case of a first modification of the above embodiment, in which the amounts of the pistons 31 and 32 are controlled based on the temperature of the premixed gas and the combustion chamber pressure, the three dimensional data map shown in FIG. 9A is replaced with a two dimensional data map (hereafter referred to as temperature vs. compression-ratio map) as shown in the FIG. 9B, which represents a relation between the temperature of the premixed gas and the necessary compression ratio. Then the steps S120 and S130 of FIG. 7 may be modified so that the control unit 11 detects at the step S120 only the temperature of the premixed gas and calculates at the step S130 the necessary compression ratio by applying the detected temperature to the temperature vs. compression-ratio map.

In a case of a second modification of the above embodiment, in which the displacement amounts of the pistons 31 and 32 are controlled based on the air-fuel ratio of the premixed gas as well as the combustion chamber pressure, the three dimensional data map shown in FIG. 9A is replaced with a two dimensional data map (hereafter referred to as air-fuel ratio vs. compression ratio map) as shown in the FIG. 9C, which represents a relation between the air-fuel ratio and the necessary compression ratio. Then the steps S120 and S130 of FIG. 7 may be modified so that the control unit 11 detects at the step S120 only the air-fuel ratio of the premixed gas and obtains at the step S130 the necessary compression ratio by applying the detected air-fuel ratio to the air-fuel ratio vs. compression ratio map.

In a case of a third modification of the above embodiment, in which the displacement amounts of the pistons 31 and 32 are controlled based on the temperature and the air-fuel ratio of the premixed gas, the steps S150 to S175 of FIG. 7 and the process of FIG. 11 may be omitted.

In a case of a fourth modification of the above embodiment, in which the displacement amounts of the pistons 31 and 32 are controlled based on either one of the temperature and the air-fuel ratio of the premixed gas, the steps S150 to S175 of FIG. 7 and the process of FIG. 11 may be omitted in the first or the second modification.

In a case of a fifth modification of the above embodiment, in which the displacement amounts of the pistons 31 and 32 are controlled based on only the combustion chamber pressure, the steps S120 to S140 of FIG. 7 may be omitted and the steps S170 and S175 may be modified in such a manner that the necessary thrust power and the necessary frequency are calculated by increasing (at the steps S175) or decreasing (at the step S170) the current thrust power and the current oscillation frequency of the linear motors 110 and 210 by predetermined amounts.

In an alternative method for controlling the displacement amounts of the pistons 31 and 32 based on the combustion chamber pressure, a two dimensional data map (hereafter referred to as a pressure vs. compression ratio map) is prepared, wherein the map represents a relation between a peak pressure (i.e. a maximum pressure) in the combustion chamber 23 and the necessary compression ratio. Then the necessary compression ratio is obtained by applying the detected peak pressure to the pressure vs. compression ratio map. The necessary thrust power and the necessary frequency are calculated by applying the obtained necessary compression ratio to the two dimensional data map as shown in FIG. 10. And finally, the thrust power and the oscillation frequency of the linear motors 110 and 210 are adjusted to meet the necessary thrust power and the necessary frequency calculated above.

As already described above, the combustion timing, at which the mixed gas in the combustion chamber 23 is auto-ignited, may not be limited to the timing at which the pistons 31 and 32 reach at the top dead center. Any other given timings may be selected if the energy of the fuel is most efficiently converted into the driving forces to the pistons 31 and 32. Therefore, the combustion timing can be near the timing at which the pistons 31 and 32 reach at the top dead center.

In addition, the control unit 11 may detect the amount of the displacements of the pistons 31 and 32 by detecting phases of the output electric power of the linear motors 110 and 210 (specifically electric power generated at the fixed units 121 and 221), in place of the position sensors 13 and 14.

What is claimed is:

1. In a free piston engine comprising:

a housing including a cylinder in its interior;

a first piston installed in the cylinder being allowed to move back and forth in an axial direction of the cylinder;

a second piston installed in the cylinder opposing to the first piston, being allowed to move back and forth in the axial direction and forming a combustion chamber between the first piston and the second piston;

a first and a second biasing units for respectively biasing the first and the second pistons in respective directions so that the first and second pistons move closer to each other;

an intake means for supplying the combustion chamber with mixed gas of air and fuel; and an exhaust means for exhausting combustion gas of the mixed gas from the combustion chamber, wherein the mixed gas in the combustion chamber is auto-ignited by being compressed when the first and the second pistons move closer to each other, the first and the second pistons are moved in directions away from each other due to an explosion of the mixed gas, and the first and the second pistons are subsequently moved closer to each other again by biasing forces of the first and the second biasing units, so that a fresh mixed gas is compressed and auto-ignited, a control device for the free piston engine comprising;

a first drive means for adjusting by a magnetic force a first displacement of the first piston from a first reference position;

a second drive means for adjusting by a magnetic force a second displacement of the second piston from a second reference position;

a detection means for detecting a physical quantity by which a condition of the combustion of the free piston engine can be estimated; and a displacement control means for controlling, by means of the first and the second drive means, the first and the second displacements with respect to the first and second reference positions according to the detected physical quantity, so that the mixed gas in the combustion chamber is auto-ignited at a timing which is equal to or close to an end of a compression stroke during which the first and second pistons are moved closer to each other.

2. The control device according to claim 1, wherein the physical quantity detected by the detection means comprises at least one of a temperature of the mixed gas, an air-fuel ratio of the mixed gas, and a pressure in the combustion chamber.

3. The control device according to claim 1, wherein, the first drive means comprises a first linear motor for applying a first thrust power by a magnetic force to the first piston and producing electrical power by transforming a kinetic energy of the first piston to an electric energy, the second drive means comprises a second linear motor for applying a second thrust power by a magnetic force to the second piston and producing electrical power by transforming kinetic energy of the second piston to electric energy, and the displacement control means controls the first and the second displacements with respect to the first and second reference positions, by adjusting at least one of the first and the second thrust powers applied to the first and second pistons and oscillation frequencies of the first and the second liner motors.

4. In a free piston engine comprising:

a housing including a cylinder in its interior;

a first piston installed in the cylinder being allowed to move back and forth in an axial direction of the cylinder;

a second piston installed in the cylinder opposing to the first piston, being allowed to move back and forth in the axial direction and forming a combustion chamber between the first piston and the second piston;

a first and a second biasing units for respectively biasing the first and the second pistons in respective directions so that the first and second pistons move closer to each other;

an intake means for supplying the combustion chamber with mixed gas of air and fuel; and an exhaust means for exhausting combustion gas of the mixed gas from the combustion chamber, wherein the mixed gas in the combustion chamber is auto-ignited by being compressed when the first and the second pistons move closer to each other, the first and the second pistons are moved in directions away from each other due to an explosion of the mixed gas, and the first and the second pistons are subsequently moved closer to each other again by biasing forces of the first and the second biasing units, so that a fresh mixed gas is compressed and auto-ignited, a control device for the free piston engine comprising;

a first drive means for adjusting a first displacement of the first piston from a first reference position;

a second drive means for adjusting a second displacement of the second piston from a second reference position;

a detection means for detecting a physical quantity by which a condition of the combustion of the free piston engine can be estimated; and a displacement control means for controlling, by means of the first and the second drive means, the first and the second displacements with respect to the first and second reference positions according to the detected physical quantity, so that the mixed gas in the combustion chamber is auto-ignited at a timing which is equal to or close to an end of a compression stroke during which the first and second pistons are moved closer to each other.

5. The control device according to claim 4, wherein, the first drive means comprises a first linear motor for applying a first thrust power by a magnetic force to the first piston and producing electrical power by transforming a kinetic energy of the first piston to an electric energy, the second drive means comprises a second linear motor for applying a second thrust power by a magnetic force to the second piston and producing electrical power by transforming kinetic energy of the second piston to electric energy, and the displacement control means controls the first displacement with respect to the first reference position by adjusting at least one of the first thrust power applied to the first piston and an oscillation frequency of the first liner motor, and controls the second displacement with respect to the second reference position by adjusting at least one of the second thrust power applied to the second piston and an oscillation frequency of the second liner motor.

6. In a free piston engine comprising:

a housing including a cylinder in its interior;

a first piston installed in the cylinder being allowed to move back and forth in an axial direction of the cylinder;

a second piston installed in the cylinder opposing to the first piston, being allowed to move back and forth in the axial direction and forming a combustion chamber between the first piston and the second piston;

a first and a second biasing units for respectively biasing the first and the second pistons in respective directions so that the first and second pistons move closer to each other;

an intake means for supplying the combustion chamber with mixed gas of air and fuel; and an exhaust means for exhausting combustion gas of the mixed gas from the combustion chamber, wherein the mixed gas in the combustion chamber is auto-ignited by being compressed when the first and the second pistons move closer to each other, the first and the second pistons are moved in directions away from each other due to an explosion of the mixed gas, and the first and the second pistons are subsequently moved closer to each other again by biasing forces of the first and the second biasing units, so that a fresh mixed gas is compressed and auto-ignited, a method for controlling the free piston engine comprising the steps of;

detecting a physical quantity by which a condition of the combustion of the free piston engine can be estimated; and controlling, according to the detected physical quantity, displacements of the first and the second pistons from their respective reference positions, so that the mixed gas in the combustion chamber is auto-ignited at a timing which is equal to or close to an end of a compression stroke during which the first and second pistons are moved close to each other.

7. The method according to claim 6, wherein the physical quantity to be detected comprises at least one of a temperature of the mixed gas, an air-fuel ratio of the mixed gas, and a pressure in the combustion chamber.

* * * * *